US005267675A

United States Patent [19]

Cane

[11] Patent Number: 5,267,675

[45] Date of Patent: Dec. 7, 1993

[54] POURING DEVICES FOR VISCOUS LIQUID SUCH AS PAINT

[75] Inventor: Michael R. Cane, Stockton, England

[73] Assignee: Imperial Chemical Industries PLC, London, England

[21] Appl. No.: 886,005

[22] Filed: May 20, 1992

[30] Foreign Application Priority Data

May 22, 1991 [GB] United Kingdom ..... 9111022

[51] Int. Cl.[5] ..... B65D 5/72

[52] U.S. Cl. ..... 222/556; 22/568; 22/570

[58] Field of Search ..... 222/511, 556, 567, 568, 222/570, 571, 470–474

[56] References Cited

U.S. PATENT DOCUMENTS

| | | | |
|---|---|---|---|
| 1,814,083 | 7/1931 | Flautt | 222/567 |
| 1,845,966 | 2/1932 | Flautt | 222/567 |
| 3,168,226 | 2/1965 | Underwood et al. | 222/568 |
| 3,185,358 | 5/1965 | Marler | 222/570 |
| 3,212,686 | 10/1965 | Di Pierro et al. | 222/472 |
| 3,672,547 | 6/1972 | Kozlowski | 222/567 |
| 4,750,648 | 6/1988 | Krydiak | 222/511 |
| 4,852,775 | 8/1989 | Zordan | 222/570 |
| 4,926,390 | 5/1990 | Murzsa | 222/570 |

*Primary Examiner*—Robert P. Olszewski

*Assistant Examiner*—Steven M. Reiss

*Attorney, Agent, or Firm*—Cushman, Darby & Cushman

[57] ABSTRACT

Pouring devices for accurate blending of color tinters to a base paint are known, but are generally of metal construction including a spout covered by a movable cover plate, with accurate pouring being due mainly to the rigidity of the metal components providing a sharp flow cut-off upon closure of the plate. The invention provides an accurate pouring device including essentially two plastics components in which a sharp flow cut-off can be achieved irrespective of the natural resilience normally present in plastic material. The two components are a cover plate (3) with an integral operating lever (4), and a spout (10) integral with a support body (1). The support body base (5) is elongate and when fitted to a liquid container engages an extended area of the container wall (19) to provide a stable support and to absorb loads applied to the device during use. Connection means are provided for detachably connecting the device over an aperture (20) in the container, including a circular recess (6) in the support body. The recess has a screw thread (7) for engaging a threaded boss (25) upstanding around the aperture. The boss may be an integral part of the container, or a separate collar (21) snap fitted into the aperture.

5 Claims, 2 Drawing Sheets

POURING DEVICES FOR VISCOUS LIQUID SUCH AS PAINT

Figure 1:
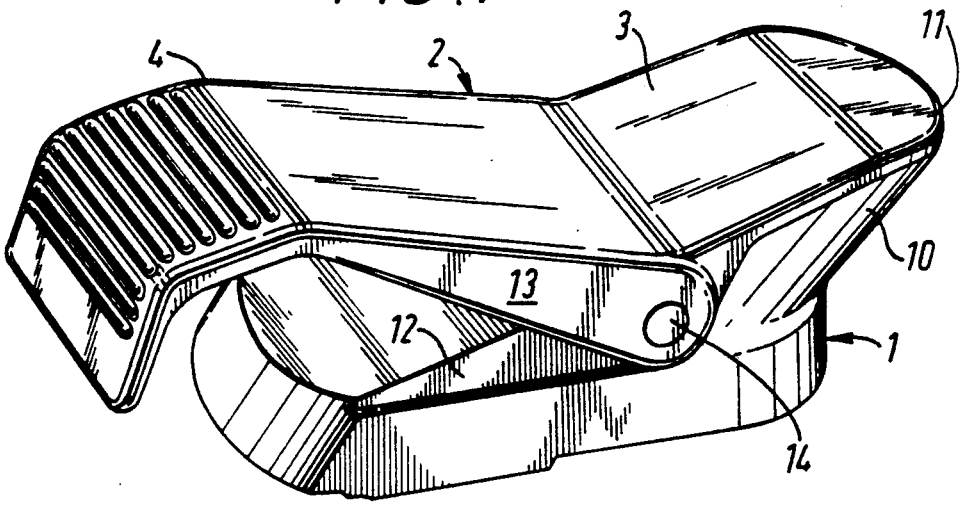

This invention relates to a pouring device for pouring liquid suspensions (referred to herein collectively as liquids) and is especially useful for pouring liquids (for example, paints and paint components, especially waterborne paints), that tend to be viscous.

The paint manufacturer is faced increasingly with a demand from the public to supply paints in greater ranges of colours In relation to decorative paints, (that is to say paints to the decoration of buildings) professional specifiers and do-it-yourself enthusiasts call for access to a wide range of colours and finishes. In motor vehicle refinishing, that is to say the repainting of vehicles after crash repair and the respray of commercial vehicles in company livery, there is a call for access to a wide range of paint colours. The only practical way such calls can be met is for the paint manufacturer to provide a mixing scheme.

Typically a mixing scheme consists of a base paint (generally called a mixing basic), a collection of coloured tinters and other paint components and a recipe card. The tinters and other components are added to the base paint according to the recipe card to produce the required colour.

In the case of paints for motor vehicle re-spray it is usual for the tinters to be added by being poured by hand from individual containers, eg paint cans; of course, this operation needs to be carried out accurately to ensure that the exact colour required is obtained. Normally, this is achieved by placing a container partly filled with the base paint to a predetermined weight on scales and pouring the or each tinter required into the base colour container up to a weight prescribed by the recipe. It is known to provide a pouring device for this operation which is constructed out of metal and comprises a lid provided around its periphery with a number of rotatable locking levers by which it can be fitted and sealed onto a standard container of a single particular size (eg 1 liter or 2½ liter round can) the lid being integral with a pouring spout. The mouth of the pouring spout is defined by a frontal lip and is normally closed by a cover plate having a mating face. To achieve closing of the spout, the cover plate is either mounted on a pivot and biased downwardly into abutting contact with the frontal lip, or the cover plate is mounted to be moved in sliding contact along said frontal lip, and is biased to cover the spout. The spout can then be readily uncovered by manual pressure via an appropriate operating lever against the bias. In use, each tint container is tipped to a position in which the plane of the frontal lip is substantially vertical so that the tint liquid will separate cleanly from the lip. Such devices have proved efficient in use and, in particular, the seal provided by the metal cover plate on the spout has been effective due mainly to the rigidity of the metal components. However, the known constructions do not readily enable the device to be made in plastics material, due mainly to the difficulty in achieving an effective seal because of the inherent resilience of suitable plastics material. Furthermore, they cannot be used for a range of different sized standard containers.

A container top is known from U.S. Pat. No. 2272867 which has a pouring device designed for pouring a viscous liquid such as syrup. Thus, the pouring device comprises a spout having a frontal lip defining its mouth, a cover plate associated therewith which is pivotally mounted and biased into abutting closing contact with the mouth lip, and operating means for the cover plate. The frontal lip is extended rearwardly to provide an annular opening, an inner wall defining the annular opening tapering outwardly towards the mouth lip to provide an annular seat, and an abutting face of the cover plate being formed with a shaped wall adapted to fit snugly within and around said seat when closed. The arrangement of the seat and the shaped wall on the cover plate, together with the fact that these components are of metal, or like rigid non-resilient material, enables the flow of syrup to be sheared-off and prevent drippage. However, it will be appreciated that accuracy of pouring is not important with this known kind of pouring device.

An object of the invention is to provide a pouring device generally of the kind discussed above having a construction which enables it to be produced from plastics material and provide accurate pouring in use.

A further object of the invention is to provide a pouring device generally of said kind which can be used for a range of different sized and/or shaped containers.

According to the invention, such a pouring device is characterised in that it is substantially wholly provided by two components formed from suitable plastics material. A cover plate and operating means are integral and provide one component. A spout is formed integrally with a support body to provide the other component. The support body has connection means by which the device can be detachably and sealingly connected over an aperture in a liquid container to which it is to be fitted, said support body defines a passage for communicating with liquid in the container. Further the base of the support body is elongate and adapted so that, when fitted to the liquid container, the base engages over an extended area of an adjacent container wall to provide a stable support and absorb loads applied to the wall during use.

Conveniently, the connection means may comprise a recess having a screw thread adapted to screw onto a threaded boss defining the aperture, a threaded closure cap being provided for said boss when the pouring device is not fitted to a container.

The operating means are preferably in the form of a lever, and the integral cover plate and lever preferably pivotally mounted on the support body about an axis close to the spout whereby the annular opening of said spout can be opened and closed via the cover plate by a rocking motion of the lever.

Figure 2:
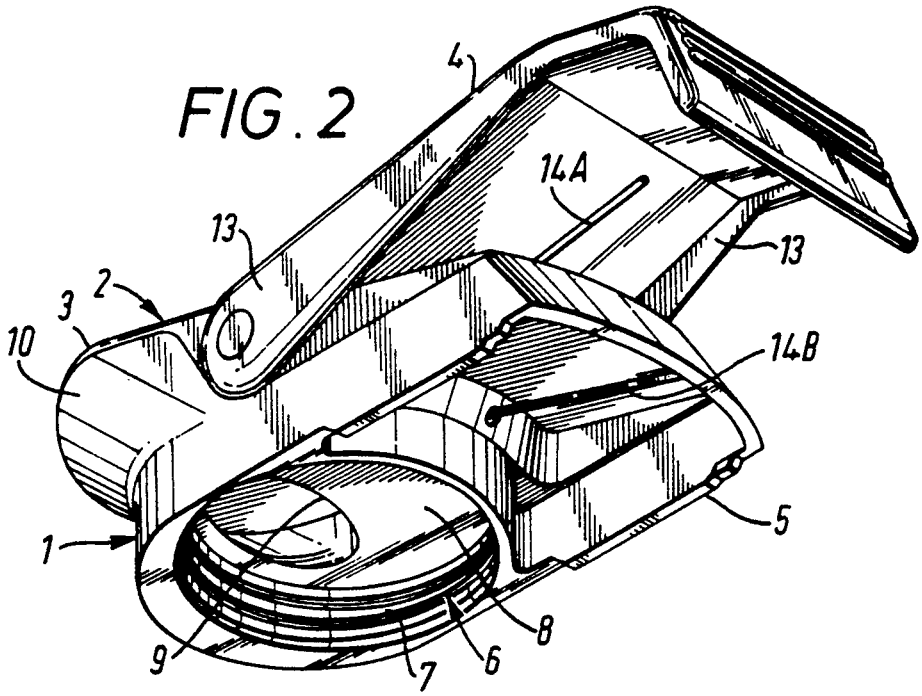
Figure 3:
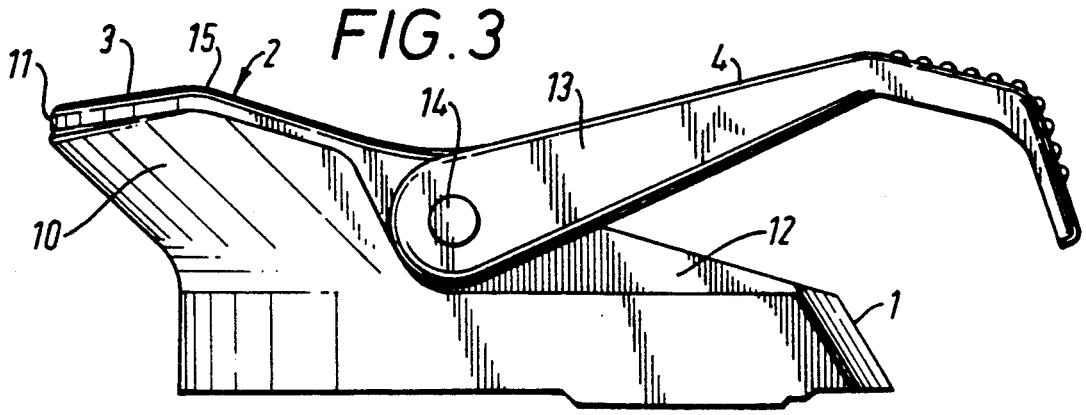
Figure 4:
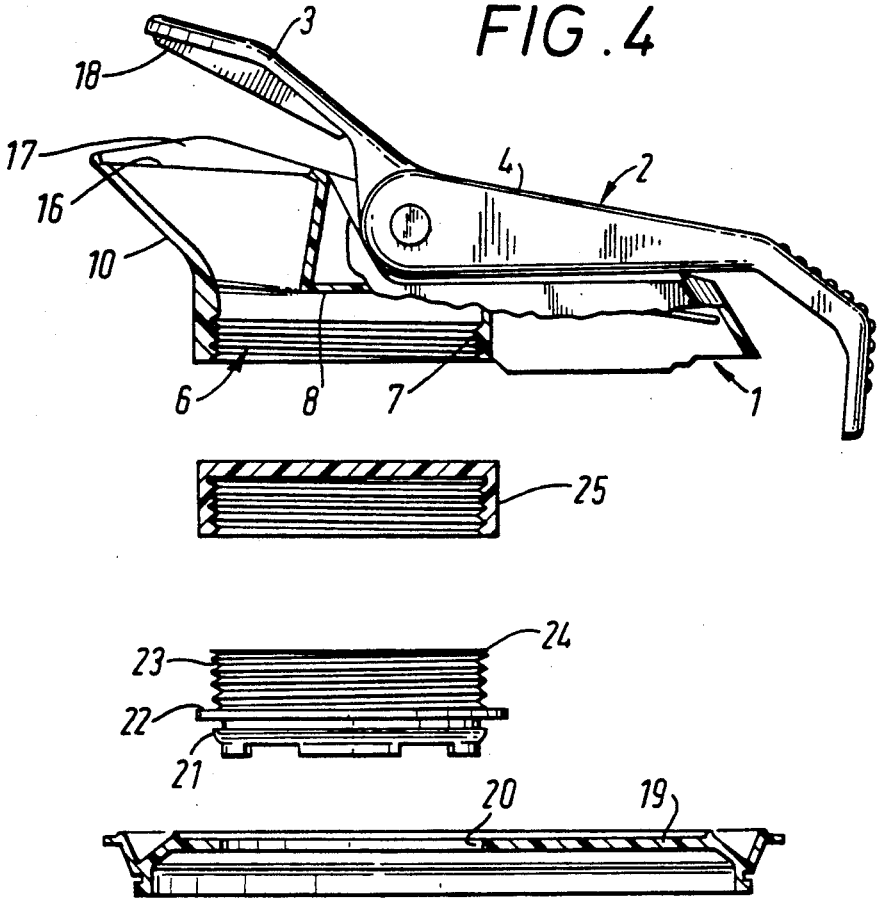
Figure 5:
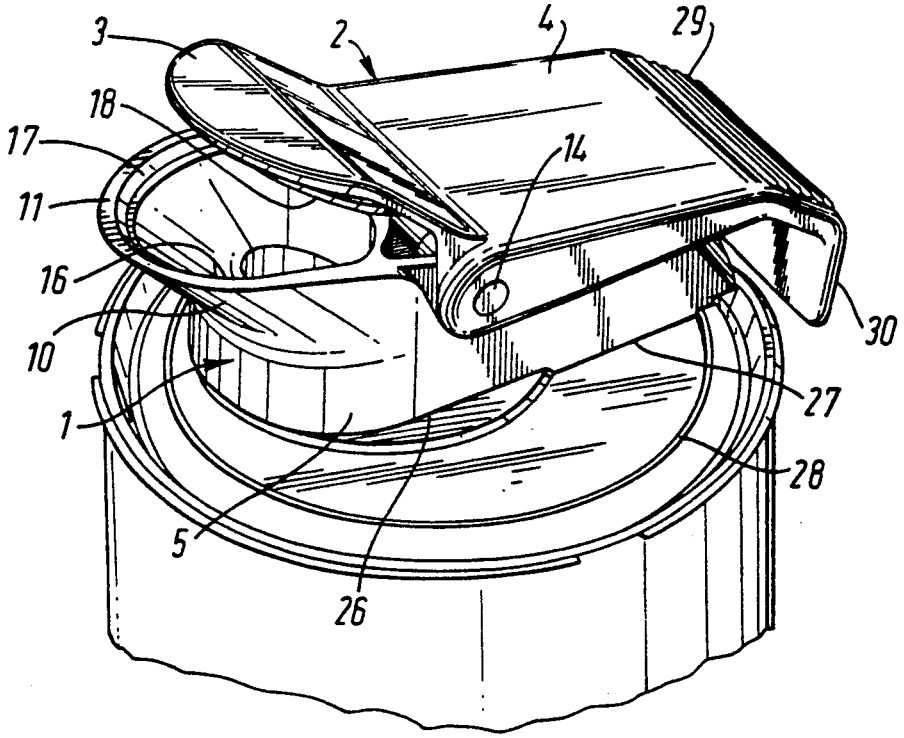

In order that the invention may be readily understood, a preferred embodiment of pouring device particularly for blending colour tinters with a base paint to produce a waterborne paint of a required colour for the re-finishing of motor vehicles, will now be described with reference to the accompanying drawings, in which FIG. 1 is a perspective view from above of the preferred pouring device, FIG. 2 is a perspective view from below, of the device, FIG. 3 is a side-elevation of the device in a closed condition, FIG. 4 is a view similar to FIG. 3, partly in cross-section, in an open condition and showing exploded the connection components to the container, and FIG. 5 is a further perspective view from above showing the device in an open condition and fitted to a container in the form of a standard size circular paint can.

Referring to FIGS. 1 to 4, the pouring device comprises essentially a support body 1 and a closure 2 providing a cover plate 3 and an operating lever 4 integrally formed therewith. Thus, the device is substantially wholly provided by two components which may conveniently be moulded from a suitable thermoplastics material, ie a material having a high degree of rigidity which is non-toxic and chemically resistant to the colour tints; suitable materials may be Polypropylene and Nylon, or filled plastics, for example Nylon filled with fibre glass.

The support body 1 is formed with an elongate base 5 which defines a circular recess 6 (see FIG. 2) provided with a screw thread 7 and the end wall 8 of this recess defines a shaped aperture 9 constituting a communicating passage which opens into a flared spout 10 upstanding from the base. The frontal lip 11 of the spout 10 is rounded as shown so as to be easy to clean. Rearwardly of the spout, the support body has side walls 12 which are formed to provide shaped recesses to accomodate opposed side walls 13 of the closure 2. The side walls 13 of the closure are pivotally mounted on the side walls 9 of the body 1 via cooperating bearing holes through which a pivot pin 14 extends. It will be noted that the connection between the closure 2 and support body 1 is such that the pivot axis provided by the pin 14 is close to the spout 10. Hence, the spout can be readily opened and closed via the cover plate 3 by a rocking motion of the lever 4.

The cover plate 3 of the closure 2 is normally biased to its closed condition by a torsion spring which is wound around the pin 14 and has opposed straight ends 14A and 14B (see FIG. 2) acting between the support body 1 and operating lever 4.

The cover plate 3 of the closure 2 is rounded and dimensioned to mate with the lip 11 of the flared spout 10. The lip 11 in this embodiment (see particularly FIG. 3) is angled as shown at 15 along its rearward extension. This angle is designed to present the frontal part of the lip in an advantageous orientation for efficient pouring i.e. so that the container does not need to be tipped completely into the horizontal plane to enable the plane of the lip to be substantially vertical during use. Also, the mating angle provided in the cover plate enhances the rigidity of this plate.

Referring particularly to FIGS. 4 and 5, it will be seen that the frontal lip 11 of the spout is extended rearwardly to produce an annular mouth opening 16 which is circular; the inner wall of the body 1 defining this mouth provides a circular seat 17 which tapers outwardly and upwardly to the mouth lip. Furthermore, the mating face of the cover plate 3 is provided with a projecting annular rib 18 having a tapered circular outer face which is dimensioned to fit snugly into and around the seat 17 when closed. In this manner, the spout 10 can be closed positively, the rib 18 cutting through the colour tint being poured and into engagement .with its seat, thereby providing an abrupt cut-off to the flow. This enables accurate pouring to be achieved. Furthermore, the annular rib 18 provides further rigidity to the cover plate 2.

Referring to FIG. 4, the pouring device is adapted to be attached to a range of different colour tint paint containers, e.g. circular plastics cans of different diameters collapsible, bag-in-box type containers, shaped blow-moulded bottles, etc. In this embodiment, the device is shown attached to the lid 19 of a known design of round plastics can. The lid is provided with an aperture 20 of a single, standard diameter into which is force fitted a collar 21 whereby a flange 22 on the collar is forced against the outer face of the lid; thus the flange acts to seal the aperture and to strengthen the lid around said aperture. The collar has a threaded boss 23 with a feathered edge 24 for sealing. The aperture in the lid is normally closed-off for storage and transportation by a cap 25. When the can is to be used, the cap is simply unscrewed and the pouring device fitted and sealed onto the boss via its threaded recess 6.

Referring to FIG. 5, it will be noted that the elongate base 5 of the pouring device has a shaped bottom edge so as to provide a pair of parallel projecting lugs 27. Thus, when the pouring device is fitted into position on the boss 23, the lugs 27 bear on the surrounding flat area of the lid 19 between the boss and a circumferential lip 28 normally provided around the perimeter of the plastics lid. Thereby, the elongate base 5 is in contact over a significant area of the lid and acts to provide a stable support and absorb loads applied to the lid when the lever 4 is operated during use. It will also be noted that the lever 4 is of a significant width and its free end 29 is extended so that it projects clear of the can it is fitted to. This is to enable the end of the lever to be freely available to the user during the pouring operation. Thus, in use, the can would be tipped close to the hoizontal to bring the pouring lip substantially vertical over the base paint container. Pressure would then be applied by the user's fingers rather than thumb of one hand to the end of the lever, as appropriate, to produce a rocking motion of the lever around its pivot pin 14, thereby causing the cover plate 3 to open for accurate dispensing of a required weight of colour tint.

The end of the lever 4 has a downwardly directed wall 30 to facilitate lifting of the can, particularly from a storage shelf, and handling of same.

I claim:

1. A pouring device for dispensing liquids from a container having an aperture, the pouring device comprising:

a support body of plastics material including a pouring spout, said pouring spout having a frontal lip defining a pouring mouth, the frontal lip defining an annular opening; and a cover plate of plastics material pivotably mounted on said support body and biased to be in abutting closing contact with said frontal lip to close said annular opening, said cover plate including an operating member for moving said cover plate from a biased, closed position to an open position, an inner wall defining said annular opening tapering outwardly towards the frontal lip so as to define an annular seat, the cover plate having an abutting face formed so as to mate with said annular seat when said cover plate is in the biased, closed position, said support body including:

a base portion extending from said pouring mouth, said base portion adapted to be fitted on a wall of the container housing the liquid so as to contact an extended area of the wall to absorb loads applied to the device during use; and connection means for detachably and sealingly connecting the pouring device over the aperture defined in a wall of the container so as to communicate said pouring mouth with the liquid in the container, said connecting means including a recess adapted to be fitted on a boss defined around the aperture of the container, said recess including locking means which cooperate with locking means of the boss for securing said support body to the boss.

2. A pouring device according to claim 1, wherein the boss forms part of a collar, the collar adapted to be disposed in the aperture of the container wall, the collar having a flange which is forced against an outer face of the wall for sealing a periphery of said aperture and fixing said collar in position on the container.

3. A pouring device according to claim 1 or 2, wherein said locking means of said recess includes screw threads, the locking means of the boss including screw threads which mate with the screw threads of the recess.

4. A pouring device according to claim 1 or 2, wherein said operating member comprises a lever, the cover plate and said lever are pivotally mounted on said support body about an axis adjacent said pouring mouth whereby said annular opening can be opened and closed via the cover plate by a rocking motion of said lever, the lever has a length so as to project beyond a side wall of the liquid container to which it is to be fitted, and a free end of said lever has a downwardly directed wall which extends beyond said side wall of the container when fitted thereto for lifting and handling the container.

5. A pouring device according to claim 1 or 2, wherein the inner tapered wall defining said annular opening is shaped along its outer edge to define a mouth lip, the mouth lip is angled at corresponding positions along its rearward extensions, and said cover plate is shaped with an angle across a width thereof so as to mate with the angled mouth lip.

* * * * *